US005631212A

United States Patent [19]

Vrahopoulou

[11] Patent Number: 5,631,212

[45] Date of Patent: May 20, 1997

[54] ENGINE OIL

[75] Inventor: Elisavet P. Vrahopoulou, Chatham, N.J.

[73] Assignee: Exxon Research and Engineering Company, Florham Park, N.J.

[21] Appl. No.: 589,175

[22] Filed: Jan. 19, 1996

Related U.S. Application Data

[63] Continuation-in-part of Ser. No. 359,792, Dec. 20, 1994, abandoned.

[51] Int. Cl.[6] ..... C10M 141/06; C10M 129/26

[52] U.S. Cl. ..... 508/192; 508/385; 508/536

[58] Field of Search ..... 252/35, 37, 37.5, 252/49.6, 39, 32.7, 33.6, 51.5 A; 508/192, 385, 536

[56] References Cited

U.S. PATENT DOCUMENTS

| | | | |
|---|---|---|---|
| 4,705,641 | 11/1987 | Goldblatt et al. | 252/35 |
| 4,915,857 | 4/1990 | Emert et al. | 252/37 |
| 4,938,880 | 7/1990 | Waddoups et al. | 252/32.7 |
| 4,966,719 | 10/1990 | Coyle et al. | 252/42.7 |
| 4,995,996 | 2/1991 | Coyle et al. | 252/46.4 |
| 5,019,283 | 5/1991 | Beltzer et al. | 252/33.6 |

FOREIGN PATENT DOCUMENTS 0562172 9/1993 European Pat. Off. .

OTHER PUBLICATIONS

A.B. Greene and T.J. Risdon, "The Effect of Molybdenum--Containing, Oil–Soluble Friction Modifiers", SAE No. 811187 (1981) month unknown.

*Primary Examiner*—Margaret Medley
*Attorney, Agent, or Firm*—Roy J. Ott

[57] ABSTRACT

A lubricating oil composition having improved fuel economy, wear resistance and antioxidancy properties which comprise a lubricating oil basestock, an oil-soluble copper salt, an oil-soluble molybdenum salt, a Group II metal salicylate and a borated polyalkenyl succinimide.

9 Claims, No Drawings

ENGINE OIL

CROSS REFERENCE TO RELATED APPLICATIONS

This is a continuation-in-part application of U.S. patent application Ser. No. 08/359,792 filed Dec. 20, 1994, now abandoned.

BACKGROUND OF THE INVENTION

1. Field of the Invention

This invention relates to a lubricating oil composition for internal combustion engines having improved fuel economy, wear resistance and antioxidancy properties.

2. Description of the Related Art

While the majority of moving parts in an internal combustion engine are in a state of hydrodynamic lubrication, some sliding parts such as pistons and valve trains are in a boundary lubrication state. In order to provide wear resistance caused by friction in the boundary lubrication state, it is necessary to provide the engine oil with additives to reduce wear. For many years, zinc dialkyldithiophosphates ("ZDDP") have been a standard antiwear additive. While ZDDP is a good antiwear agent, it has negative impacts on fuel economy. Thus it is usually necessary to include a friction modifier for fuel economy purposes. Both antiwear and friction modifiers function through adsorption on the sliding metal surface and may interfere with each other's respective functions.

U.S. Pat. No. 4,705,641 describes an engine oil having improved antiwear and antioxidancy properties. The engine oil contains from 0.002 to 0.3 wt % of a copper salt and from 0.004 to 0.3 wt % of a molybdenum salt. This combination is also stated to reduce the treat rate of ZDDP necessary for wear protection. There is no mention of the frictional properties of the engine oil.

European patent application EP 562,172 describes an engine oil having improved frictional properties. The engine oil contains a boron compound derivative of alkenylsuccinimide, an alkaline earth metal salt of salicylic acid and either or both of a molybdenum dithiophosphate and a molybdenum dithiocarbamate. There is no mention of the wear or antioxident properties of the claimed additive combination.

It is well known in the art that in formulating engine oils, there is a delicate balance between friction and wear performance. It would be desirable to have an engine oil with improved fuel economy, wear resistance and antioxidancy to meet the increasing performance demands placed on modern oils due to environmental considerations.

SUMMARY OF THE INVENTION

This invention relates to a lubricating oil composition having improved fuel economy, wear resistance and antioxidancy which comprises:

(a) a lubricating oil basestock;

(b) from 0.002 to 1.0 wt %, based on oil composition, of a copper salt;

(c) from 0.004 to 4 wt %, based on oil composition, of a molybdenum salt;

(d) from 50 to 4000 ppmw, based on oil composition, of a Group II metal atoms present as metal salicylate; and (e) at least 2 wt %, based on oil composition, of a borated polyalkenyl succinimide.

In another embodiment, this invention relates to a method for improving fuel economy, wear resistance and antioxidancy properties in an internal combustion engine which comprises operating the engine with the lubricating oil composition described above.

DETAILED DESCRIPTION OF THE INVENTION

The engine oil according to the invention requires a major amount of lubricating oil basestock. The lubricating oil basestock can be derived from natural lubricating oils, synthetic lubricating oils, or mixtures thereof. Suitable lubricating oil basestocks include basestocks obtained by isomerization of synthetic wax and slack wax, as well as hydrocrackate basestocks produced by hydrocracking (rather than solvent extracting) the aromatic and polar components of the crude. In general, the lubricating oil basestock will have a kinematic viscosity ranging from about 2 to about 1,000 cSt at 40° C.

Natural lubricating oils include animal oils, vegetable oils (e.g., castor oils and lard oil), petroleum oils, mineral oils, and oils derived from coal or shale.

Synthetic oils include hydrocarbon oils and halo-substituted hydrocarbon oils such as polymerized and interpolymerized olefins, alkylbenzenes, polyphenyls, alkylated diphenyl ethers, alkylated diphenyl ethers, alkylated diphenyl sulfides, as well as their derivatives, analogs, and homologs thereof, and the like. Synthetic lubricating oils also include alkylene oxide polymers, interpolymers, copolymers and derivatives thereof wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from $C_5$ to $C_{12}$ monocarboxylic acids and polyols and polyol ethers.

Silicon-based oils (such as the polyakyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

Copper salts are oil-soluble and may be cuprous or cupric salts. Copper salts are salts of synthetic or natural organic acids, preferably mono- and dicarboxylic acids. Preferred carboxylic acids are $C_{10}$ to $C_{30}$ saturated and unsaturated fatty acids and polyisobutenyl succinic acids and their anhydrides wherein the polyisobutenyl group has a number average molecular weight of 700 to 2500. Examples of preferred copper salts include copper oleate, topper stearate, copper naphthenate and the copper salt of polyisobutenyl succinic acid or anhydride wherein the polyisobutenyl group has an average molecular weight 800–1200. The amount of copper salt is preferably from 0.05 to 0.6 wt %, based on lubricating oil composition.

Molybdenum salts are oil-soluble salts of synthetic or natural organic acids, preferably salts of mono- and dicarboxylic acids. Preferred carboxylic acids are $C_4$ to $C_{30}$ saturated and unsaturated fatty acids. Examples of preferred molybdenum salts include molybdenum naphthenate, hexanoate, oleate, xanthate and tallate. The amount of molybdenum salt is preferably from 0.01 to 3.0 wt %, based on lubricating oil composition.

The Group II metals in the metal salicylates include beryllium, magnesium, calcium, strontium, and barium. Preferred Group II metal salicylates are magnesium salicylate and calcium salicylate. The amount of Group II metal salicylate is present at from 0.1 to 8 wt %, based on lubricant oil composition provided that the amount of Group II metal atoms present as metal salicylate is from 50 to 4000 ppmw.

Borated polyalkenyl succinimide dispersants are described in U.S. Pat. No. 4,863,624. Preferred borated dispersants are boron derivatives derived from polyisobutylene substituted with succinic anhydride groups and reacted with polyethylene amines, polyoxyethylene amines, and polyol amines (PIBSA/PAM) and are preferably added in an amount from 2 to 16 wt %, based on oil composition. These reaction products are amides, imides or mixtures thereof. The borated dispersants are "over-borated", i.e., they contain boron in an amount from 0.5 to 5.0 wt % based on dispersants. These over-borated dispersants are available from Exxon Chemical Company. The amount of boron in the engine oil should be at least about 500 ppmw, preferably about 900 ppmw. In addition to borated dispersants, other sources of boron which may contribute to the total boron concentration include borated dispersant VI improvers and borated detergents.

If desired, the lubricating oil composition may contain other additives known in the art. Such additives include other dispersants, other antiwear agents, other antioxidants, rust inhibitors, corrosion inhibitors, other detergents, pour point depressants, extreme pressure agents, viscosity index improvers, other friction modifiers, antifoam agents and hydrolytic stabilizers. Such additives are described in "Lubricants and Related Products" by Dieter Klamann, Verlag Chemie, Weinheim, Germany, 1984.

The lubricating oil compositions can be used in the lubricating system of essentially any internal combustion engine such as automobile and truck engines, marine engines and railroad engines.

The invention may be further understood by reference to the following examples, which include a preferred embodiment.

EXAMPLES 1–10

These examples, including comparative examples, demonstrate the effects of the additive combination according to the invention. The ball-on-cylinder (BOC) friction test, 4-ball wear test and differential scanning calometry tests are described as follows.

BOC tests were performed using the experimental procedure described by S. Jahanmir and M. Beltzer in ASLE Transactions, 29, No. 3, p. 425 (1985) except that a force of 0.8 Newtons (1Kg) rather than 4.9 Newtons was applied to a 12.5 mm steel ball in contact with a rotating steel cylinder having a 43.9 mm diameter. The cylinder rotates inside a cup containing a sufficient quantity of lubricating oil to cover 2 Mm of the bottom of the cylinder. The cylinder was rotated at 0.25 rpm. The frictional force was continuously monitored by means of a load transducer. In the tests conducted, friction coefficients attained steady state values after 7 to 10 turns of the cylinder. Friction experiments were run at an oil temperature at 104° C.

The Four Ball test used is described in detail in ASTM method D-2266, the disclosure of which is incorporated herein by reference. In this test, three balls are fixed in a lubricating cup and an upper rotating ball is pressed against the lower three balls. The test balls utilized were made of AISI 52100 steel with a hardness of 65 Rockwell C (840 Vickers) and a centerline roughness of 25 nm. Prior to the tests, the test cup, steel balls, and all holders were washed with 1,1,1 trichloroethane. The steel balls subsequently were washed with a laboratory detergent to remove any solvent residue, rinsed with water, and dried under nitogen.

The Four Ball wear tests were performed at 100° C., 60 kg load, and 1200 rpm for 45 minutes duration. After each test, the balls were washed and the wear scar diameter on the lower balls measured using an optical microscope.

Oxidative differential scanning calorimetry (oxidative DSC) is a procedure that assesses the antioxidancy of a lubricating oil. In this DSC test, a sample of oil is heated in air at a programmed rate, e.g., 5° C./minute and the sample temperature rise relative to an inert reference measured. The temperature at which an exothermic reaction occurs (the oxidation onset temperature) is a measure of the oxidative stability of the sample.

The oil used in the following examples is a fully formulated 5W-30 oil, to which the components specified in Table 1 have been added. All components are commercially available as noted in the Table.

TABLE 1

| | EXAMPLES | | COMPARATIVE EXAMPLES | | | | | | | |
|---|---|---|---|---|---|---|---|---|---|---|
| | 1 | 2 | 3 | 4 | 5 | 6 | 7 | 8 | 9 | 10 |
| Mg sulfonate(1) | | | X | | X | | X | X | | |
| Mg salicylate(2) | X | X | | X | | X | | | X | X |
| PIBSA/PAM(3) | | | X | X | | | X | X | | |
| Overborated PIBSA/PAM(4) | X | X | | | X | X | | | X | X |
| Cu oleate(5) | X | X | | | | | X | X | X | |
| Molybdenum naphthenate(6) | | X | | | | | | X | | |
| Molybdenum hexanoate(6) | X | | | | | | X | | | |
| Molybdenum dithiocarbamate | | | | | | | | | X | X |

TABLE 1-continued

| | EXAMPLES | | COMPARATIVE EXAMPLES | | | | | | | |
|---|---|---|---|---|---|---|---|---|---|---|
| | 1 | 2 | 3 | 4 | 5 | 6 | 7 | 8 | 9 | 10 |
| Boron concentration (ppm) | 1340 | 1320 | 11 | 12 | 1260 | 1320 | 21 | 16 | 1340 | 1300 |
| Mg concentration (ppm) | 1350 | 1330 | 1380 | 1340 | 1300 | 1350 | 1370 | 1400 | 1360 | 1320 |
| Cu concentration (ppm) | 47 | 40 | 0 | 0 | 0 | 0 | 47 | 38 | 41 | 0 |
| Mo concentration (ppm) | 432 | 416 | 0 | 0 | 0 | 0 | 427 | 421 | 436 | 450 |
| BOC friction coefficient | 0.11 | 0.12 | 0.36 | 0.35 | 0.13 | 0.15 | 0.28 | 0.27 | 0.11 | 0.12 |
| 4-ball wear diameter (mm) | 0.54 | 0.57 | 0.73 | 0.78 | 0.70 | 0.71 | 0.66 | 0.56 | 0.69 | 0.87 |
| DSC temperature (°C.) | 242 | 244 | 226 | 229 | 242 | 259 | 235 | 236 | 246 | 255 |

(1)Commercially available from Exxon Chemical Company.
(2)Commercially available from Shell Chemical Company.
(3)Commercially available from Exxon Chemical Company.
(4)Commercially available from Exxon Chemical Company.
(5)Commercially available from Exxon Chemical Company.
(6)Commercially available from OM Group, Inc.

Examples 1 and 2 demonstrate that the combination of copper salt, molybdenum salt, Group II metal salicylate and borated PIBSA-PAM produces superior results in the combination of friction coefficient measured by BOC, wear measured by 4-ball, and oxidation stability measured by DSC. This additive combination results in unexpected improved results. Comparative Examples 3 and 4 show that switching from Mg sulfonate to Mg salicylate had a slightly negative effect on wear scar diameter. Comparative Examples 3 and 5 are directed to the effect of non-borated vs. borated PIBSA-PAM dispersant. While the borated PIBSA-PAM shows a significantly reduced friction coefficient and better oxidative stability, there was almost negligible improvement in wear. Changing both the detergent and dispersant, comparative examples 3 and 6, shows improved friction coefficient and oxidation, but little effect on wear scar diameter. In comparing Examples 1 and 2 according to the invention with comparative examples 7 and 8, it can be seen that the combination of Group II metal salicylate and borated PIBSA-PAM with copper salt and molybdenum salt provides improvement in all three properties, i.e., in friction coefficient, wear and oxidation performance.

Comparative Example 10 is consistent with the engine oil composition of EP 562,172: it contains Mg salicylate detergent, borated PIBSA/PAM dispersant and molybdenum dithiocarbamate. This additive combination has inferior wear performance compared with the claimed invention, Examples 1 and 2. Addition of Cu salt in Comparative Example 9 improves the wear performance over that of Comparative Example 10, but is still inferior compared with the claimed invention.

What is claimed is:

1. A lubricating oil composition having improved fuel economy, wear resistance and antioxidancy properties which comprises:

(a) a lubricating oil base stock;

(b) from 0.002 to 1.0 wt %, based on oil composition, of a copper salt, (c) from 0.004 to 4 wt %, based on oil composition, of an oil-soluble molybdenum salt of an organic acid of $C_4$–$C_{30}$ saturated or unsaturated carboxylic acid;

(d) from 50 to 4000 ppmw, based on oil composition, of a Group II metal atoms present as metal salicylate; and (e) from 2 to 16 wt %, based on oil composition, of a borated polyalkenyl succinimide wherein the amount of boron in the oil is at least 900 ppm, based on oil.

2. The composition of claim 1 wherein the copper salts are salts of organic acids.

3. The composition of claim 2 wherein the organic acids are mono- or dicarboxylic acids.

4. The composition of claim 1 wherein one metal salicylate is magnesium salicylate, calcium salicylate or mixtures thereof.

5. The composition of claim 1 wherein the succinimide is a borated polyisobutenyl succinimide.

6. A method for improving the fuel economy performance of an internal combustion engine which comprises operating the engine with the engine oil of claim 1.

7. The composition of claim 1 wherein the oil-soluble molybdenum salt of an organic acid is selected from the group consisting of molybdenum naphthenate, molybdenum hexanoate and mixtures thereof and the copper salt is copper oleate.

8. The composition of claim 7 wherein the oil-soluble molybdenum salt of an organic acid is molybdenum naphthenate.

9. The composition of claim 8 wherein the oil-soluble molybdenum salt of an organic acid is molybdenum hexanoate.

* * * * *